US007043776B1

(12) United States Patent
Wu

(10) Patent No.: US 7,043,776 B1
(45) Date of Patent: May 16, 2006

(54) SHOWER ASSEMBLY

(76) Inventor: Chao-Chang Wu, No. 88-1, Chien Ming Rd., Ta Li City, Taichung Hsien (TW)

( * ) Notice: Subject to any disclaimer, the term of this patent is extended or adjusted under 35 U.S.C. 154(b) by 0 days.

(21) Appl. No.: 11/069,862

(22) Filed: Feb. 28, 2005

(51) Int. Cl.
*A47K 3/22* (2006.01)

(52) U.S. Cl. ..... 4/601

(58) Field of Classification Search ..... 4/567–568, 4/570, 601
See application file for complete search history.

(56) References Cited

U.S. PATENT DOCUMENTS 3,471,872 A * 10/1969 Symmons ..... 4/570
5,749,552 A * 5/1998 Fan ..... 248/205.8
6,550,080 B1 * 4/2003 Grewal ..... 4/662
6,567,998 B1 * 5/2003 D'Ugo ..... 4/569
6,643,862 B1 * 11/2003 Aitken ..... 4/601
6,829,790 B1 * 12/2004 Petrovic et al. ..... 4/601
6,973,682 B1 * 12/2005 Zhadanov ..... 4/601
2005/0193487 A1 * 9/2005 Watari ..... 4/570

* cited by examiner

*Primary Examiner*—Charles E. Phillips
(74) *Attorney, Agent, or Firm*—Dellett & Walters

(57) ABSTRACT

A shower assembly has a standing pipe, a connector, an overhead pipe, a fixed overhead shower head, a control valve, a handheld showerhead, a handheld showerhead bracket and a directional valve. The connector has a three-way passage. The directional valve is mounted inside the passage to direct water to flow selectively into either the overhead pipe or the standing pipe and has a tubular valve body, a valve rod, a primary disk and a secondary disk. The tubular valve body has a top opening, a bottom opening and a side opening communicating respectively with three ends of the passage. The valve rod is moveably mounted in the valve body. The primary disk and the secondary disk are mounted on the valve rod to selectively close the top opening or the bottom opening.

6 Claims, 6 Drawing Sheets

SHOWER ASSEMBLY

BACKGROUND OF THE INVENTION

1. Field of the Invention

The present invention relates to a shower assembly, and more particularly to a shower assembly with a simplified structure, which is convenient to use.

2. Description of Related Art

Shower assemblies mounted in a bathroom are a fixed overhead showerhead or a handheld showerhead. To make the traditional shower assembly more versatile, a conventional shower assembly has been developed, which can be used in either the fixed or handheld mode. However, such conventional shower assemblies have complex structures and cannot be switched conveniently from one mode to the other.

To overcome the shortcomings, the present invention provides a shower assembly to mitigate or obviate the aforementioned problems.

SUMMARY OF THE INVENTION

The main objective of the invention is to provide a shower assembly that has a simplified structure and is convenient to use. The shower assembly has a standing pipe, a connector, an overhead pipe, a fixed overhead showerhead, a control valve, a handheld showerhead, a handheld showerhead bracket and a directional valve. The standing pipe has a top, a bottom and a central passage defined through the standing pipe. The connector is attached to the top of the standing pipe and has a three-way passage defined through theconnector. The passage has an inner surface, an inlet, a secondary outlet and a primary outlet. The secondary outlet communicates with the central passage in the standing pipe. The overhead pipe is connected to the connector and has a proximal end attached to theconnector, a distal end and a channel. The channel is defined through the overhead pipe and communicates with the primary outlet of the passage in theconnector. The fixed overhead showerhead is attached to the distal end of the overhead pipe. The control valve is attached to the bottom of the standing pipe. The handheld showerhead is connected to the control valve with a hose. The handheld showerhead bracket is mounted on the standing pipe to hold the handheld showerhead. The directional valve is mounted inside the passage to control water to flow selectively into one of the channel in the overhead pipe and the central passage in the standing pipe and has a tubular valve body, a valve rod, a primary disk and a secondary disk. The tubular valve body is mounted inside the passage and has an inner surface, a top, a bottom, a top opening, a bottom opening and a side opening. The top opening is defined in the top and communicates with the primary outlet of the passage. The bottom opening is defined in the bottom, communicates with the secondary outlet of the passage and has an inner surface. The side opening is radially defined through the valve body and communicates with the inlet of the passage. The valve rod is moveably mounted in the valve body and has a top, a bottom and a head formed on the top. The primary disk is mounted around the top of the valve rod to selectively close the top opening in the valve body. The secondary disk is mounted around the bottom of the valve rod to selectively close the bottom opening in the valve body. The secondary disk has a bottom and an annular recess defined in the bottom to form a resilient annular flange abutting against the inner surface of the bottom opening to close the bottom opening.

Other objects, advantages and novel features of the invention will become more apparent from the following detailed description when taken in conjunction with the accompanying drawings.

DETAILED DESCRIPTION OF PREFERRED EMBODIMENT

Figure 1:
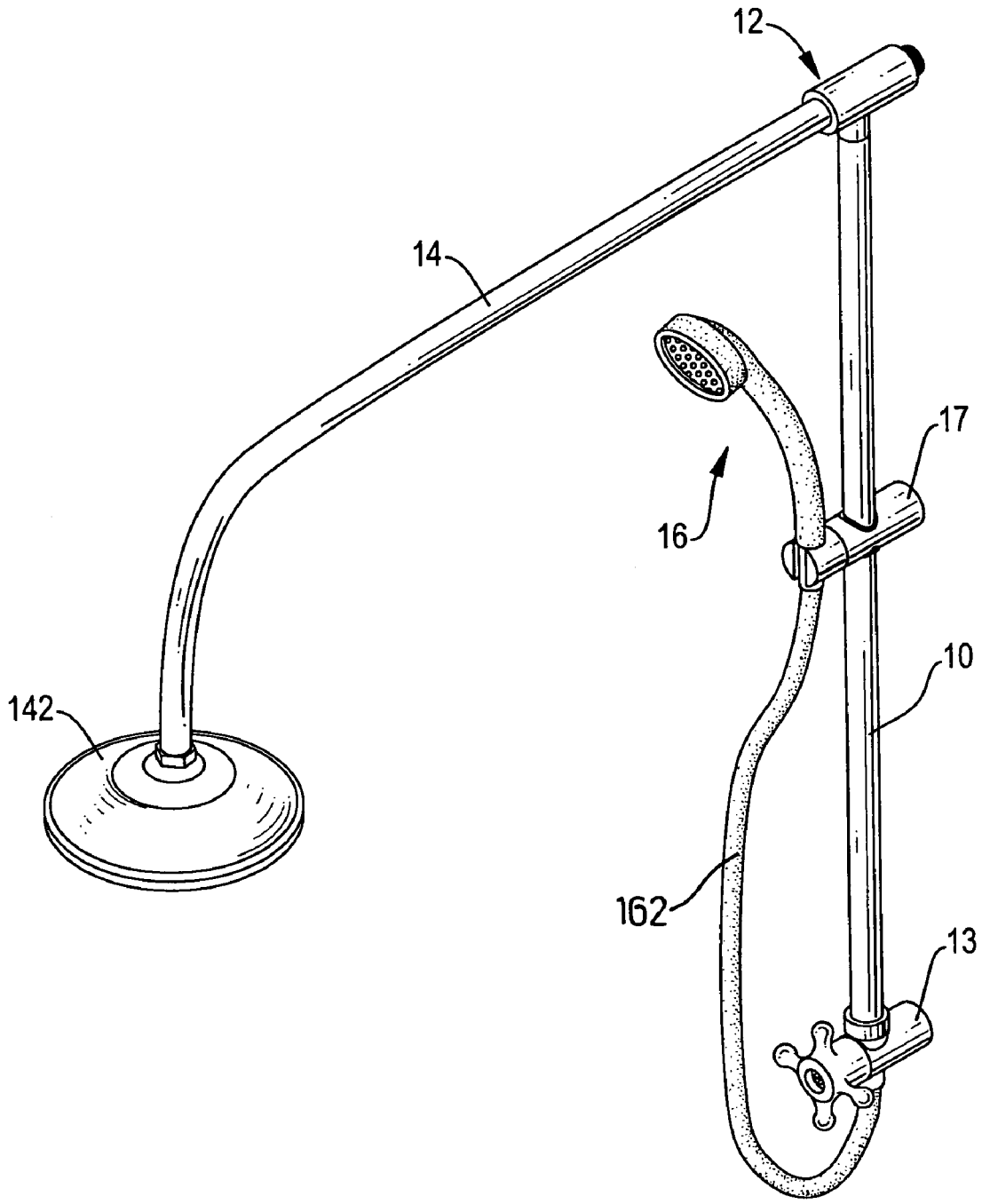
FIG. 1 is a perspective view of a shower assembly in accordance with the present invention.
Figure 3:
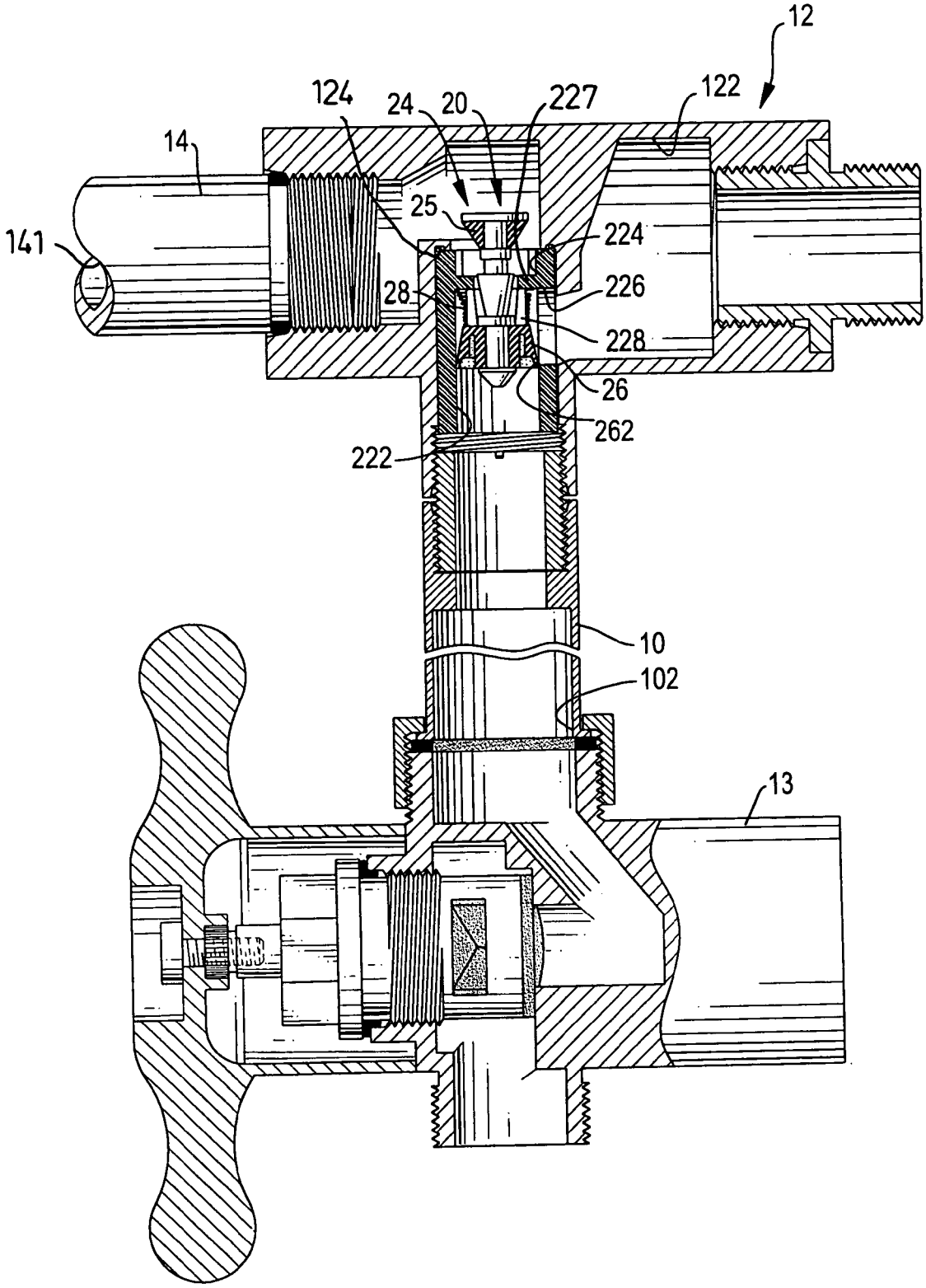
FIG. 3 is a compressed side view in partial section of the shower assembly in FIG. 1.

With reference to FIGS. 1 and 3, a shower assembly in accordance with the present invention comprises a standing pipe (10), a connector (12), an overhead pipe (14), a fixed overhead showerhead (142), a control valve (13), a handheld showerhead (16), a handheld showerhead bracket (17) and a directional valve (20).

The standing pipe (10) has a top, a bottom and a central passage (102) defined through the standing pipe (10).

The connector (12) is attached to the top of the standing pipe (10) and has a three-way passage (122) defined through the connector (12). The passage (122) has an inner surface, an inlet, a secondary outlet, a primary outlet and multiple optional mounting holes (124). The secondary outlet communicates with the central passage (102) in the standing pipe (10). The connector (12) is securely attached to a wall, and the inlet of the passage (122) is connected to and communicates with a water pipe (not shown) mounted inside the wall. Accordingly, water can flow into the passage (122) from the water pipe. The mounting holes (124) are defined in the inner surface of the passage (122).

The overhead pipe (14) has a proximal end, a distal end and a channel (141). The proximal end is attached to the primary outlet of the connector (12). The channel (141) is defined through the overhead pipe (14) and communicates with the primary outlet of the passage (122) in the connector (12).

The fixed overhead showerhead (142) is attached to the distal end of the overhead pipe (14) and communicates with the channel (141) in the overhead pipe (14).

The control valve (13) is attached to the bottom of the standing pipe (10), may be attached to a wall, has an inlet, an outlet, a seat, a disk, a stem and a handle and may be a globe valve, a gate valve, a flap valve, a ball valve or any other valve configuration to selectively stop or allow water to flow through the control valve (13). The inlet is attached to the bottom of the standing pipe (10).

The handheld showerhead (16) is connected to the outlet of the control valve (13) with a hose (162).

The handheld showerhead bracket (17) is mounted on the standing pipe (10) to hold the handheld showerhead (16) and may be slidably mounted on the standing tube (10).

Figure 2:
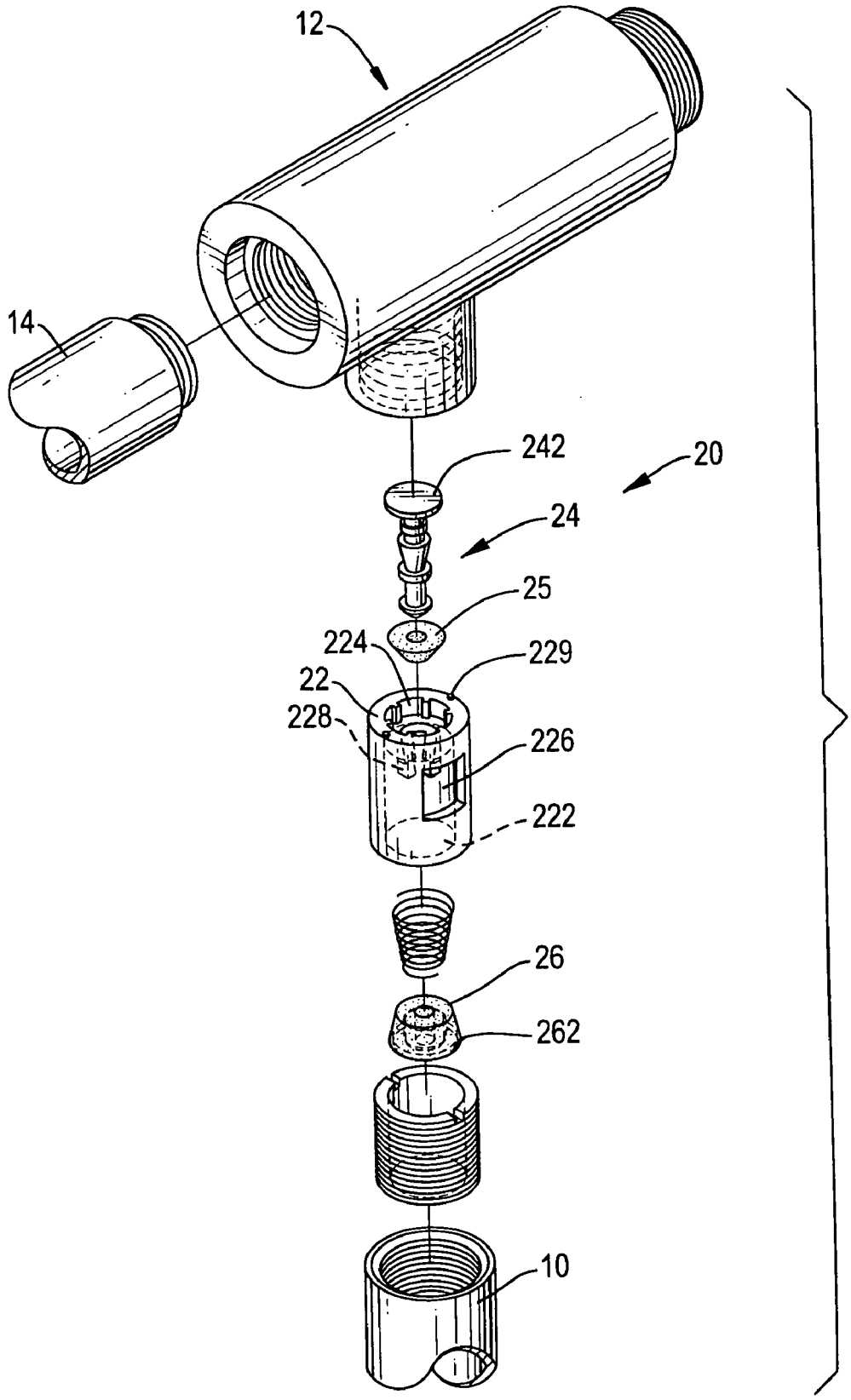
FIG. 2 is an exploded perspective view of the valve of the shower assembly in FIG. 1.

With further reference to FIG. 2, the directional valve (20) is mounted inside the passage (122) in the connector (12) to direct the water to flow selectively into either the channel (141) in the overhead pipe (14) or the central passage (122) in the standing pipe (10). The directional valve (20) comprises a valve body (22), a valve rod (24), a primary disk (25), a secondary disk (26) and an optional spring (28).

The valve body (22) is tubular, is mounted inside the passage (122) and has an inner surface, a top, a bottom, a top opening (224), a bottom opening (222), a side opening (226), an optional shoulder (227) and multiple optional mounting nubs (229). The top opening (224) is defined in the top and communicates with the primary outlet of the passage (122). The bottom opening (222) is defined in the bottom, communicates with the secondary outlet of the passage (122) and has an inner surface. The side opening (226) is radially defined in the valve body (22) and communicates with the inlet of the passage (122). The shoulder (227) is formed inside the valve body (22) between the top opening (224) and the bottom opening (222) and has a bottom and multiple ribs (228) that extend down longitudinally from the bottom around the valve rod (24). The ribs (228) cause the valve rod (24) to move smoothly relative to the valve body (22). The mounting nubs (229) are formed on the top of the valve body (22) and are held respectively in the mounting holes (124) in the inner surface of the passage (122). The engagement of the mounting nubs (229) and the mounting holes (124) holds the valve body (22) stationary relative to the connector (12). The valve rod (24) is moveably mounted in the valve body (22) and has a top, a bottom and a head (242). The head (242) is formed on the top.

The primary disk (25) is mounted around the top of the valve rod (24) to selectively close the top opening (224) in the valve body (22).

The secondary disk (26) is mounted around the bottom of the valve rod (24) to selectively close the bottom opening (222) in the valve body (22). The secondary disk (26) has a bottom and an annular recess defined in the bottom to form a resilient annular flange (262) abutting the inner surface of the bottom opening (222) to close the bottom opening (222).

The spring (28) is mounted around the valve rod (24) and has two ends respectively abutting the shoulder (227) and the secondary disk (26) to provide a recoil force to the valve rod (24).

Figure 4:
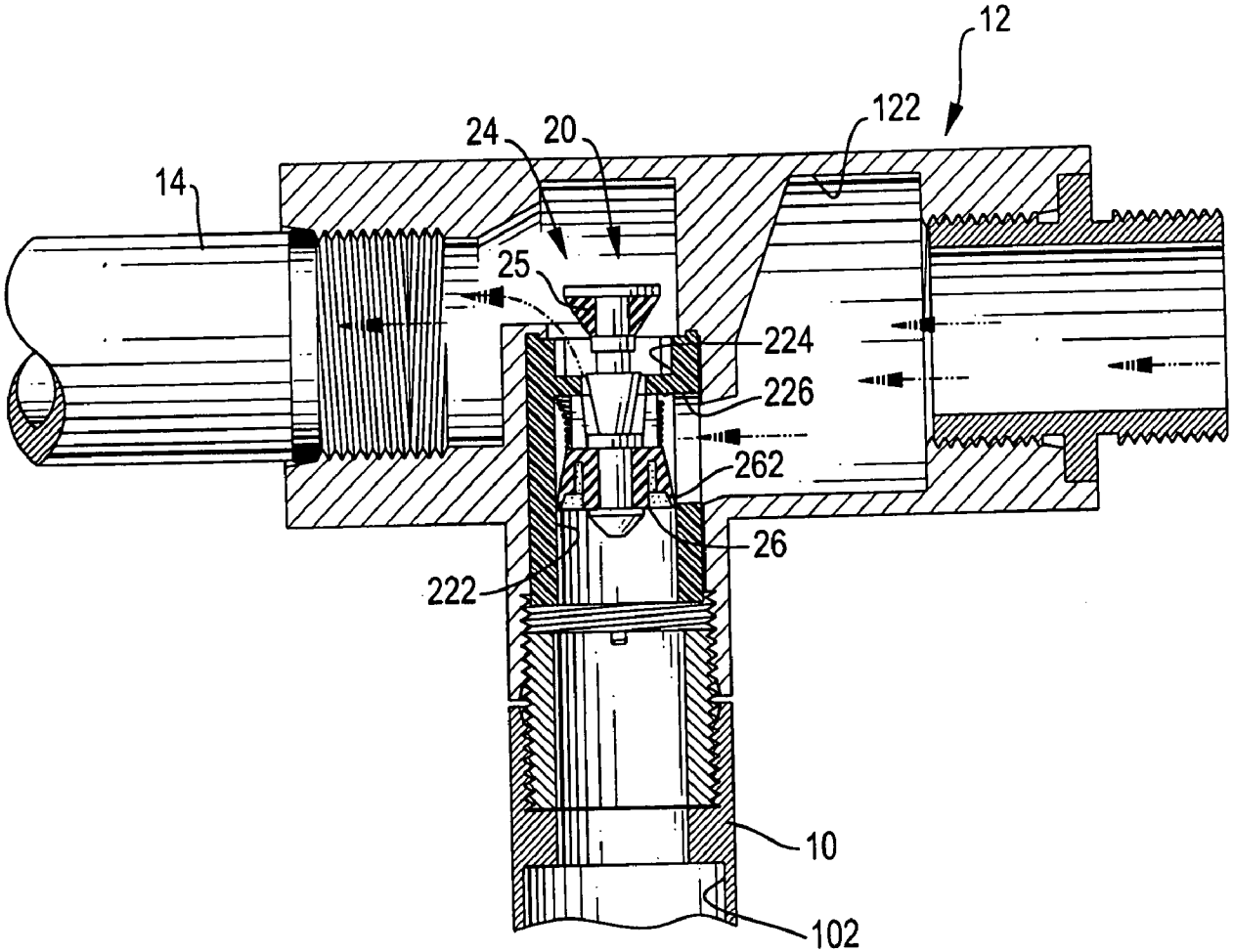
FIG. 4 is an enlarged operational side view in partial section of the connector and the valve in FIG. 1 with water flowing into the overhead pipe through the valve.

With further reference to FIG. 4, the water in the water pipe flows into the valve body (22) through the inlet of the passage (122) in the connector (12) and the side opening (226) in the valve body (22). When the control valve (13) is closed, the water blocked by the control valve (13) forces the primary disk (25) away from the top opening (224) and flows into the overhead pipe (14) through the primary outlet of the passage (122). Accordingly, the water will spray out from the fixed overhead showerhead (142), and a user can take a shower with the fixed overhead showerhead (142).

Figure 5:
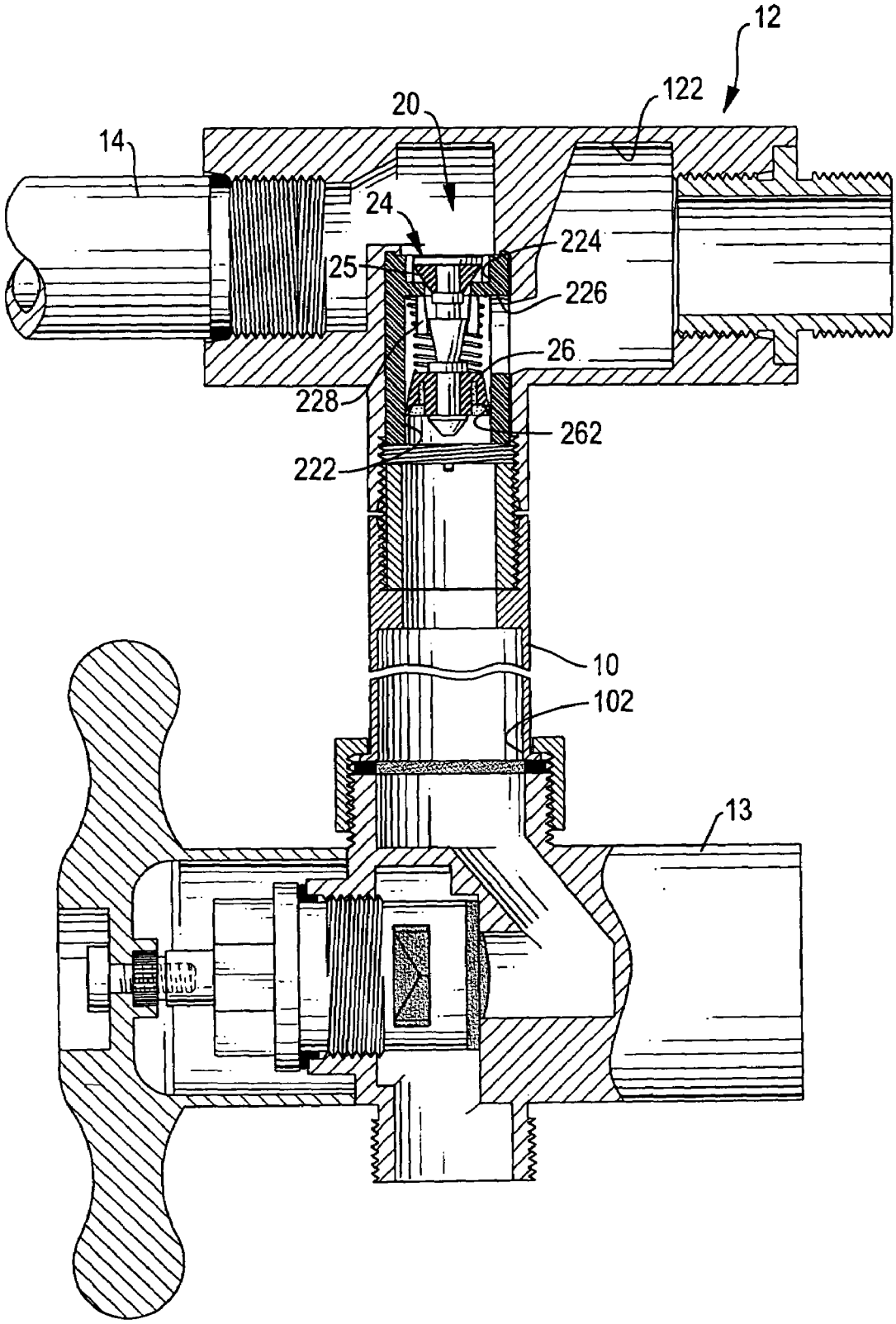
FIG. 5 is a compressed operational side view in partial section of the shower assembly in FIG. 1 with water flowing into the handheld shower fixture.
Figure 6:
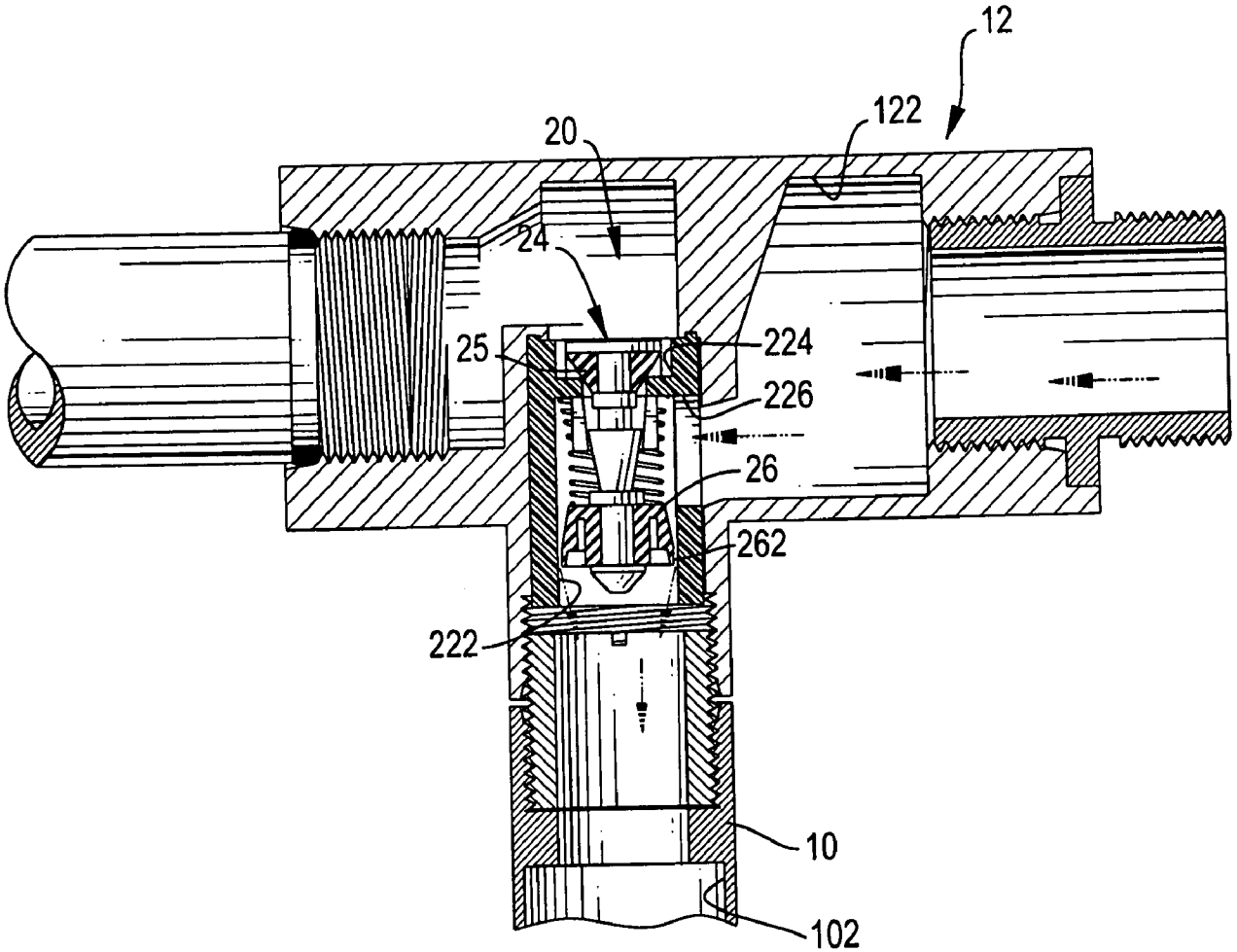
FIG. 6 is an enlarged operational side view in partial section of the connector and the valve in FIG. 5 with water flowing into the standing pipe through the valve.

With reference to FIGS. 1, 5 and 6, opening the control valve (13) relieves the pressure in the bottom opening (222) of the valve body (22), which allows the water to push the flange (262) on the secondary disk (26) toward the bottom opening (222) and cause the primary disk (25) to close the top opening (224). The increased water pressure on the flange (262) pushes the flange (262) away from the inner surface of the valve body (22) and form a gap between the secondary disk (26) and the valve body (22). Thus, the water can pass through the gap and flow to the handheld showerhead (16) through the bottom opening (222) in the valve body (22), the central passage (102) in the standing pipe (10), the control valve (13) and the hose (162).

When the control valve (13) is closed, the flow of water through the bottom opening (222) is stopped, the primary disk (25) is pushed away from the top opening (224) and the valve rod (24) moves upward, and water flows through the primary outlet to the overhead pipe (14).

The structure of a shower assembly is simplified, and the cost of manufacturing the shower assembly is lowered. In addition, operation of the shower assembly is convenient.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

I what is claimed is:

1. A shower assembly comprising:

a standing pipe having a top, a bottom and a central passage defined through the standing pipe;

a connector attached to the top of the standing pipe and having a three-way passage defined through the connector and having an inner surface, an inlet, a secondary outlet communicating with the central passage in the standing pipe and a primary outlet;

an overhead pipe connected to the connector and having
- a proximal end attached to the connector;
- a distal end; and
- a channel defined through the overhead pipe and communicating with the primary outlet of the passage in the connector;

a fixed overhead showerhead attached to the distal end of the overhead pipe;

a control valve being hollow and attached to the bottom of the standing pipe;

a handheld showerhead connected to the bottom of the standing pipe with a hose;

a handheld showerhead bracket mounted on the standing pipe to hold the handheld showerhead; and a directional valve mounted inside the passage in the connector to direct water to flow selectively into either the channel in the overhead pipe or the central passage in the standing pipe and comprising
- a tubular valve body mounted inside the passage and having
  - an inner surface;
  - a top;
  - a bottom;
  - a top opening defined in the top of the valve body and communicating with the primary outlet of the passage;
  - a bottom opening defined in the bottom of the valve body, communicating with the secondary outlet of the passage and having an inner surface; and
  - a side opening radially defined through the valve body and communicating with the inlet of the passage;
- a valve rod moveably mounted in the valve body and having
  - a top;
  - a bottom; and
  - a head formed on the top of the valve rod;
- a primary disk mounted around the top of the valve rod to selectively close the top opening in the valve body; and a secondary disk mounted around the bottom of the valve rod to selectively close the bottom opening in the valve body and having a bottom and an annular recess defined in the bottom to form a resilient annular flange abutting the inner surface of the bottom opening to close the bottom opening.

2. The shower assembly as claimed in claim 1, wherein the valve body has a shoulder formed inside the valve body between the top opening and the bottom opening; and the directional valve further comprises a spring mounted around the valve rod and having two ends respectively abutting the shoulder and the secondary disk.

3. The shower assembly as claimed in claim 2, wherein the shoulder has a bottom and multiple ribs extending downward from the bottom and around the valve rod.

4. The shower assembly as claimed in claim 3, wherein the valve body further has multiple mounting nubs formed on the top of the valve body; and multiple mounting holes are defined in the inner surface of the passage to hold respectively the mounting nubs on the valve body.

5. The shower assembly as claimed in claim 2, wherein the valve body further has multiple mounting nubs formed on the top of the valve body; and multiple mounting holes are defined in the inner surface of the passage to hold respectively the mounting nubs on the valve body.

6. The shower assembly as claimed in claim 1, wherein the valve body further has multiple mounting nubs formed on the top of the valve body; and multiple mounting holes are defined in the inner surface of the passage to hold respectively the mounting nubs on the valve body inside.

* * * * *